US006863138B2

(12) United States Patent
Siracki

(10) Patent No.: US 6,863,138 B2
(45) Date of Patent: Mar. 8, 2005

(54) HIGH OFFSET BITS WITH SUPER-ABRASIVE CUTTERS

(75) Inventor: Michael Allen Siracki, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 340 days.

(21) Appl. No.: 10/015,199

(22) Filed: Dec. 11, 2001

(65) Prior Publication Data

US 2002/0070053 A1 Jun. 13, 2002

Related U.S. Application Data

(62) Division of application No. 09/197,358, filed on Nov. 20, 1998, now Pat. No. 6,345,673.

(51) Int. Cl.[7] ..... E21B 10/16
(52) U.S. Cl. ..... 175/353; 175/376
(58) Field of Search ..... 175/376, 343, 175/353

(56) References Cited

U.S. PATENT DOCUMENTS

| | | | | | |
|---|---|---|---|---|---|
| 3,998,500 | A | | 12/1976 | Dixon | 308/8.2 |
| 4,204,437 | A | | 5/1980 | Espana | 76/108 |
| 4,249,621 | A | | 2/1981 | Espana | 175/227 |
| 4,323,284 | A | | 4/1982 | Childers et al. | 308/8.2 |
| 4,440,247 | A | | 4/1984 | Sartor | 175/393 |
| 4,611,673 | A | | 9/1986 | Childers et al. | 175/340 |
| 4,657,093 | A | * | 4/1987 | Schumacher | 175/353 |
| 4,741,406 | A | | 5/1988 | Deane et al. | 175/340 |
| 4,848,476 | A | | 7/1989 | Deane et al. | 175/340 |
| 5,351,770 | A | * | 10/1994 | Cawthorne et al. | 112/323 |
| 5,351,771 | A | | 10/1994 | Zahradnik | 175/374 |
| 5,353,885 | A | | 10/1994 | Hooper et al. | 175/378 |
| 5,542,485 | A | * | 8/1996 | Pessier et al. | 175/371 |
| 5,549,171 | A | | 8/1996 | Mensa-Wilmot et al. | 175/431 |
| 5,551,522 | A | | 9/1996 | Kieth et al. | 175/420 |
| 5,582,261 | A | | 12/1996 | Kieth et al. | 175/431 |
| 5,586,612 | A | | 12/1996 | Isbell et al. | 175/353 |
| 5,592,996 | A | | 1/1997 | Kieth et al. | 175/431 |
| 5,607,024 | A | | 3/1997 | Kieth et al. | 175/431 |
| 5,607,025 | A | | 3/1997 | Mensa-Wilmot et al. | 175/431 |
| 5,695,018 | A | | 12/1997 | Pessier et al. | 175/331 |
| 5,695,019 | A | | 12/1997 | Shamburger, Jr. | 175/333 |
| 5,769,175 | A | | 6/1998 | Matthias | 175/420 |
| 5,810,517 | A | | 9/1998 | Bostic | 407/53 |
| 5,833,020 | A | * | 11/1998 | Portwood et al. | 175/331 |
| 5,967,245 | A | * | 10/1999 | Garcia et al. | 175/374 |
| 6,068,072 | A | * | 5/2000 | Besson et al. | 175/432 |
| 6,082,470 | A | | 7/2000 | Webb et al. | 175/45 |

FOREIGN PATENT DOCUMENTS

| | | | | |
|---|---|---|---|---|
| GB | 2279095 | | 12/1994 | E21B/10/52 |
| GB | 2319549 | | 10/1997 | E21B/10/16 |
| GB | 2330850 | | 12/1997 | E21B/10/16 |
| GB | 2316112 | | 2/1998 | E21B/10/16 |
| GB | 2316112 A | * | 2/1998 | E21B/10/16 |

* cited by examiner

*Primary Examiner*—Robert E. Pezzuto
*Assistant Examiner*—Meredith Petravick
(74) *Attorney, Agent, or Firm*—Conley Rose, P.C.

(57) ABSTRACT

A roller bit is provided having super-abrasive inserts on cutting portions to assure that the bit will maintain cutting efficiency. In the described exemplary bits, the axes of the roller cones are also offset by a significant or "high offset" amount from the central longitudinal axis of the bit, thereby providing for increased shearing and grinding action by the bit. The use of high offset in combination with super-abrasive inserts provides for optimal bit cutting designs which provide increases in ROP while preserving the bit's ability to hold gage and remain durable to achieve acceptable footage. Minimum high offsets and preferred high offsets are described for various bit sizes, designs and nomenclatures, including milled tooth bits and insert-type bits designed for use in soft-through-medium formation hardnesses as well as formations with greater hardnesses.

10 Claims, 5 Drawing Sheets

HIGH OFFSET BITS WITH SUPER-ABRASIVE CUTTERS

CROSS-REFERENCE TO RELATED APPLICATIONS

This application is a divisional of Ser. No. 09/197,358, filed Nov. 20, 1998, now U.S. Pat. No. 6,345,673.

STATEMENT REGARDING FEDERALLY SPONSORED RESEARCH OR DEVELOPMENT

Not Applicable.

BACKGROUND OF THE INVENTION

1. Field of the Invention

The present invention relates generally to roller cone drill bits used for the drilling of boreholes and, more particularly, to roller cone drill bits where the axes of the cones are offset from the center of the bit and contains super-abrasive cutting elements.

2. Background of the Invention

A typical roller cone earth-boring bit includes one or more rotary cutters that perform their cutting function due to the rolling movement of the cutters acting against the formation. The cutters roll and slide upon the bottom of the borehole as the bit is rotated, the cutters thereby engaging and disintegrating the formation material in its path. The rotary cutters may be described as generally conical in shape and are therefore sometimes referred to as rolling cones, roller cones, rotary cones and so forth. Drilling fluid which is pumped downwardly through the drill pipe and out of the bit carries the removed formations material upward and out of the borehole. In oil and gas drilling, the length of time it takes to drill to the desired depth and location effects the cost of drilling a borehole. The time required to drill the well is affected by the number of times the drill bit must be changed in order to reach the targeted formation. Each time the bit is changed, the entire string of drill pipe, which may be thousands of feet long, must be retrieved from the borehole, section by section. Once the drill string has been retrieved and the new bit installed, the bit must be lowered to the bottom of the borehole on the drill string, which again must be constructed section by section. This process, known as a "trip" of the drill string, requires considerable time, effort and expense. Accordingly, it is always desirable to employ drill bits which will drill faster and/or drill more footage and which are usable over a wider range of formation hardness.

The length of time that a drill bit may be employed before it must be changed most often depends upon its rate of penetration ("ROP"), as well as its durability or ability to maintain an acceptable ROP. Bit durability is, in part, measured by a bit's ability to "hold gage," meaning its ability to maintain a full gage borehole diameter over the entire length of the borehole. Gage is required to be maintained to allow insertion of drilling apparatus as well as a decrease in ROP as well as to prevent premature gage wear of the next bit before it reaches the bottom of the hole. For example, when a new, unworn bit is inserted into an undergage borehole, the new bit will be required to ream the undergage hole as it progresses toward the bottom of the borehole. Thus, by the time it reaches the bottom, the bit may have experienced a substantial amount of wear that it would not have experienced had the prior bit been able to maintain full gage. This unnecessary wear will shorten the life of the newly-inserted bit, thus prematurely requiring the time consuming and expensive process of removing the drill string, replacing the worn bit, and reinstalling another new bit downhole.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to help maintain a constant gage and, secondarily, to prevent the erosion and abrasion of the heel surface of the rolling cone.

In addition to the heel row inserts, conventional bits typically include a gage row of cutter elements mounted adjacent to the heel surface but orientated and sized in such a manner so as to cut the corner of the borehole. In this orientation, the gage cutter elements generally are required to cut both the borehole bottom and sidewall. The lower surface of the gage row cutter elements engage the borehole bottom while the radially outermost surface scrapes the sidewall of the borehole. Excessive wear and/or breakage of the gage inserts can lead to an undergage borehole, decreased ROP, increased loading on the other cutter elements on the bit, and may accelerate wear of the cutter bearing due to inthrusting and ultimately lead to bit failure. Conventional bits also include a number of additional rows of cutter elements that are located on the cones in rows disposed radially inward from the gage row. These cutter elements are sized and configured for cutting the bottom of the borehole and are typically described as inner row cutter elements.

Roller cone bits are known which have milled cutting teeth integrally formed with the roller cone as a cutting structure. Milled tooth bits, also known as steel tooth bits, have a hardmetal matrix welded to their teeth and are typically used where it is desired to drill at a faster rate through softer formations or at lower cost. However, the milled tooth bit tends to wear faster than the insert type bits causing it to drill a lesser total distance or footage.

Insert-type roller cone bits use hardened inserts which are press fit into undersized apertures in the rolling cones to serve as the cutting structure. A common insert type is tungsten carbide. Insert-type bits are more expensive and generally do not drill at as fast a rate in soft formations as milled tooth bits, however, insert bits have a longer drilling life and are, therefore, capable of drilling a greater total distance.

Bits are usually required to be specified in terms of an IADC nomenclature number which indicates the hardness and strength of the formation in which they are designed best to be employed. The bit's IADC numeric nomenclature consists of a series of three numerals that are outlined within the "BITS" section of the current edition of the International Association of Drilling Contractors (IADC) Drilling Manual. The first numeral designates the bit's series, of which the numerals 1–3 are reserved for Milled Tooth Bits in the soft, medium and hard formations and the numerals 4–8 are reserved for insert bits in the soft, medium, hard and extremely hard formations. The second numeral designates the bit's type within the series. The third numeral relates to the mounting arrangement of the roller cones and is generally not directly related to formation hardness or strength and consequently represented by an "x" when IADC codes are referred to herein. A higher series numeral within the milled tooth and insert bit series indicates that the bit is capable of drilling in a harder formation than a bit with a lower series number. A higher type number indicates that the bit is capable of drilling in a harder formation than a bit of the same series with a lower type number. For example, a "5-2-x" IADC insert bit is capable of drilling in a harder formation than a "4-2-x" IADC insert bit. A "5-3-x" IADC insert bit is capable of drilling in harder formations than a "5-2-x" IADC insert bit. The IADC numeral classification system is subject to modification as approved by the International Association of Drilling Contractors to improve bit selection and usage.

"Offset" is a term used when the axes of rotation of the rolling, cone cutters are displaced from the longitudinal axis of the bit. When offset, also referred to as "skew," is used in a roller cone bit, the cones try to rotate on the hole bottom about a "free rolling" path, but they are not allowed to as they are attached to the bit body which forces them to rotate about the bit centerline or axis. Because the cone is forced to rotate about a non-free natural path, it imparts motions on the hole bottom that are referred to as in the art as "skidding," "gouging," "scraping" and "sliding." These motions help to apply a shearing type cutting force to the hole bottom which can be a more efficient way of removing rock than compressive failure of rock cutting also known as a "crushing action." However, these shearing cutting forces will generally wear and break insert cutting elements much faster than compressive cutting forces, particularly on the gage row inserts because they cut the corner of the borehole which is typically the hardest area of the hole for inserts to work.

The use of offset axes in roller cone bits is not unknown, but has been limited in the amount of offset used. U.S. Pat. No. 4,657,093 issued to Schumacher described offset axis bits in which the offset amount is from 1/16" to 1/8" per inch of bit diameter. Conventional tungsten carbide cutting inserts were used in the cones of these bits. Schumacher recognized that high offset cutters have not been thought practical. He noted that it was believed that increases in offset above a limit of 1/32 inch per inch of bit diameter would gain very little in cutting efficiency, but would increase the amount of breakage of inserts in the bits. Schumacher taught that bits utilizing offsets of 1/32" to 1/16" per inch of bit diameter did not provide significant increases in ROP and drilling efficiency. Schumacher also taught that offset bits with tungsten carbine cutting inserts were primarily advantageous for soft to medium-soft formations. Schumacher also suggested that bits using his range of increased offset would suffer greater amounts of hard metal insert breakage. Thus, Schumacher's bits were limited in the amount of total footage they could drill, as he provided no solution for the increased insert cutting element wear and/or breakage encountered. The benefits of increases in ROP were intended to offset the losses in potential total footage drilled. Increasing offsets generally leads to increased wear and/or breakage particularly on gage inserts that can create sharp edges and/or or thermal fatigue that leads to catastrophic insert breakage.

In an attempt to reduce the incidence of insert breakage, the cutting inserts could be made of tougher, and therefore less hard, insert material. However, such a design would sacrifice insert hardness, resulting in the bit becoming dull more quickly during use. As a result, the useful life for the offset bit would be shortened significantly.

Therefore, a need exists for a bit that is able to take advantage of increased ROP due to a high offset while at the same time better resisting insert breakage so that acceptable total footage can be drilled by the bit. Additionally, a need exists for such a bit that can be used in harder formations.

SUMMARY OF THE INVENTION

The present invention provides a "high" offset bit with reduced risk of insert breakage and wear by use of super-abrasive cutter elements so that improved cutting structures are provided among different bit types. High offset amounts are defined and described for the improved cutting structures offer an optimal mix of improved ROP, increased bit life and an enhanced ability to hold gage.

In the inventive bits, the axes of the roller cones are offset by a significant amount from the central longitudinal axis of the bit, thereby providing for significantly increased shearing and grinding action by the bit. The offsets used in particular bit types are larger, or "high," in relation to prior art offset bits of that type. "High offsets" provide for increased sliding, gouging and scraping action upon the rock, thus resulting in greater drilling efficiency and ROP.

Further, the offset roller cones of the bits present gage cutting portions that have super-abrasive cutting surfaces, such as polycrystalline diamond (PCD) or cubic boron nitride coating (CBN). Gage inserts, secondary gage inserts, off-gage inserts and/or heel row inserts, provide the gage cutting portions, in most cases. The use of super-abrasive surfaces permits the amount of bit axis offset to be increased into high offset ranges without resulting in the bit becoming prematurely dull. At the same time, the use of super-abrasive cutting surfaces in high-offset bits results in an unexpectedly low incidence of insert breakage, allowing for increased footage drilled and/or sustained increases in ROP. Super-abrasive inserts, such as polycrystalline diamond coated inserts have greater wear resistance as well as have better thermal fatigue resistance as compared to conventional tungsten carbide inserts, which ultimately gives them better resistance breakage.

In accordance with the general concepts and principles of the invention, a number of exemplary high offset bit configurations are described. Bits are described that are suitable for use in formations of different hardnesses and in different drilling conditions and applications.

Specific embodiments are described herein wherein specific high offsets are defined and described for different bit diameters. For milled tooth bits and insert-type bits suitable for soft to medium-hard formations, minimum high offsets are provided which are at least 1/8 inch when the bit diameter is less than 4 inches, at least 5/32 inches when the bit diameter is 4 inches or greater and less than 5 inches, at least 1/4 inches when the bit diameter is 5 inches or greater and less than 7 inches, at least 11/32 inches when the bit diameter is 7 inches or greater and less than 9 inches, at least 13/32 inches when the bit diameter is 9 inches or greater and less than 12 inches, at least 7/16 inches when the bit diameter is 12 inches or greater and less than 16 inches, and at least 17/32 inches when the bit diameter is at least 16 inches. Particular ranges of high offsets are described as well. For soft to low strength formations, it is preferred that the offsets be at least 3/16 inches when the bit diameter is less than 4 inches, at least 1/4 inches when the bit diameter is at least 4 inches and less than 5 inches, at least 5/16 inches when the bit diameter is at least 5 inches and less than 7 inches, at least 7/16 inches when the bit diameter is at least 7 inches and less than 9 inches, at least 9/16 inches when the bit diameter is at least 9 inches and less than 12 inches, at least 3/4 inches when the bit diameter is at least 12 inches and less than 16 inches, and at least 1 inch when the bit diameter is at least 16 inches.

Recommended offsets are also provided for insert-type bits used for medium-hard to hard formations. For example, for use in extremely hard and high strength formations, the offset is greater than 1/16 inches and less than 3/32 inches when the bit diameter is less than 7 inches, at least 3/32 inches and less than 5/32 inches when the bit diameter is at least 7 inches and less than 12 inches, and at least 5/32 inches and less than 7/32 inches when the bit diameter is at least 12 inches.

In addition, high offsets and offset ranges are described for bits which have different IADC numeric nomenclatures and bit journal angles.

Thus, the present invention comprises a combination of features and advantages which enable it to overcome various shortcomings of prior devices. The various characteristics described above, as sell as other features, will be readily apparent to those skilled in the art upon reading the following detailed description of the preferred embodiments of the invention, and by referring to the accompanying drawings.

BRIEF DESCRIPTION OF THE DRAWINGS

For an introduction to the detailed description of the preferred embodiments of the invention, reference is made to the following accompanying drawings wherein.

DETAILED DESCRIPTION OF THE PREFERRED EMBODIMENT

Because increased offsets result in greater insert breakage, as described above, one would think that a tougher, and therefore less hard, insert would be necessary to solve the insert breakage problem. The invention recognizes, however, that, the use of super-abrasive coatings on bit inserts, in combination with high offset, allows bits to drill acceptable footage at an increased ROP. The offset provides the ROP while the super-abrasive inserts provide the durability to achieve acceptable footage and maintain ROP.

Figure 1:
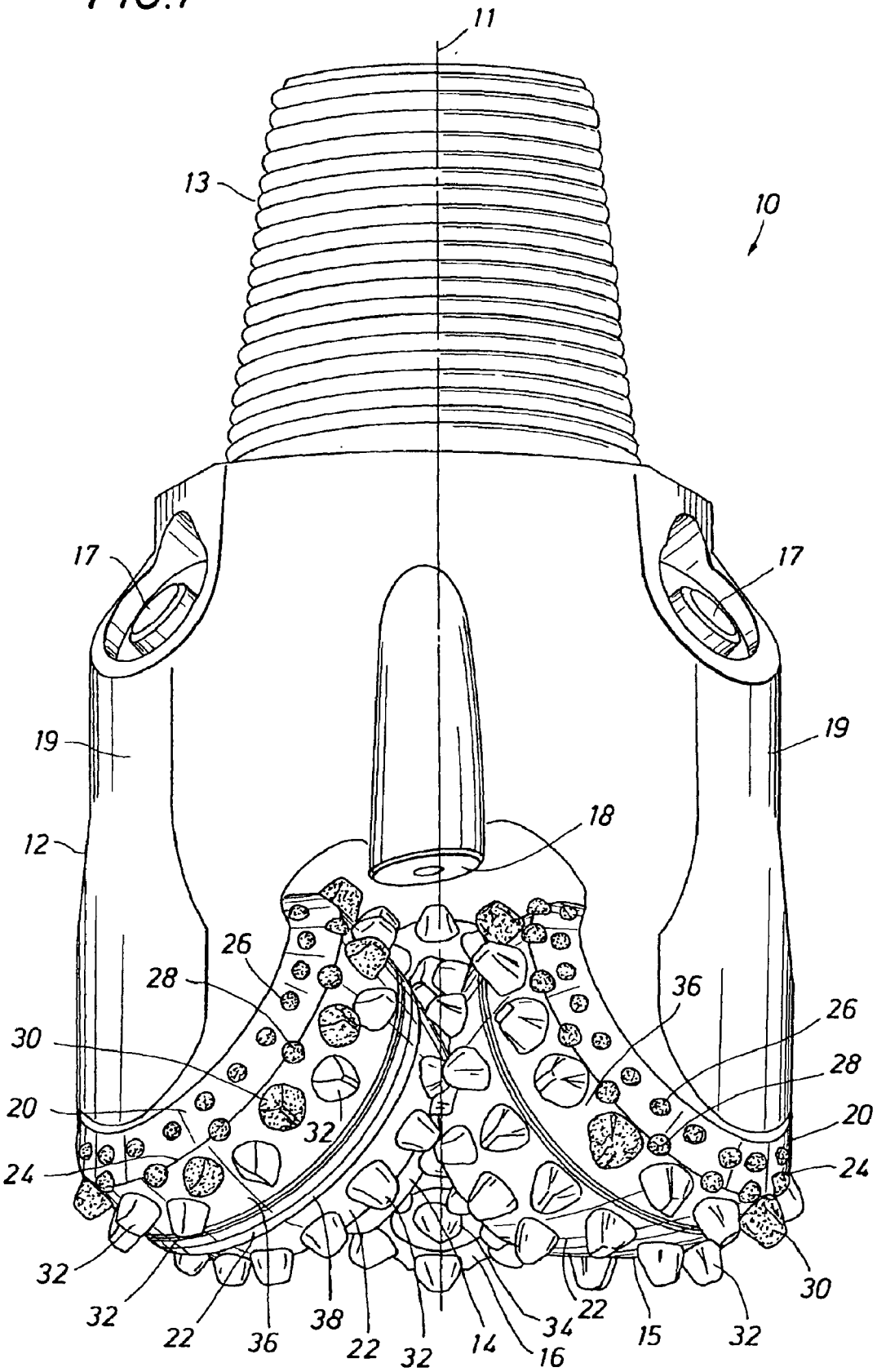
FIG. 1 is a perspective view of an insert-type rolling cone cutter bit constructed in accordance with the present invention.
Figure 2:
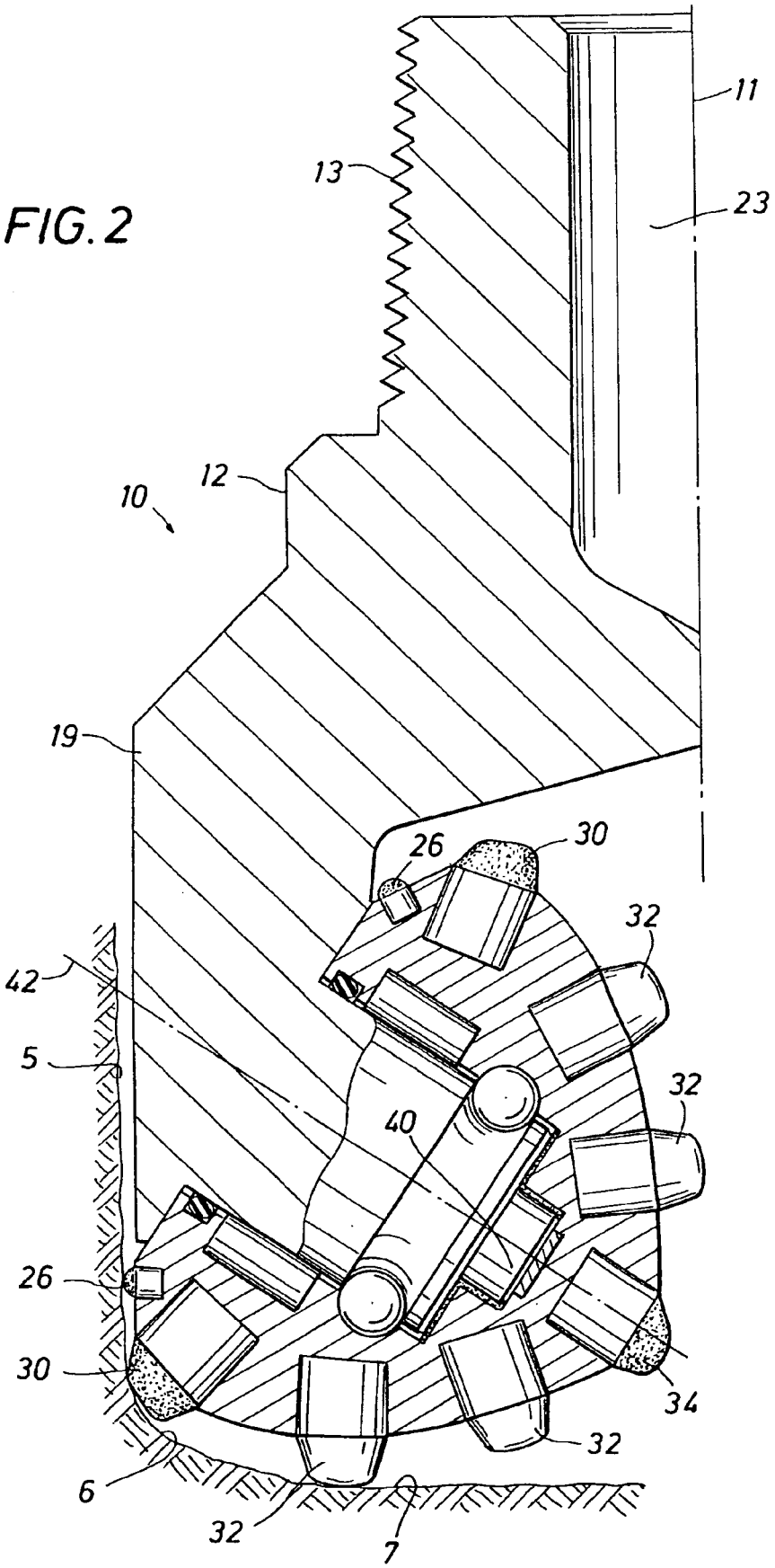
FIG. 2 is a cross-sectional view of a portion of the bit in FIG. 1 showing a mounted roller cone cutter.
Figure 3:
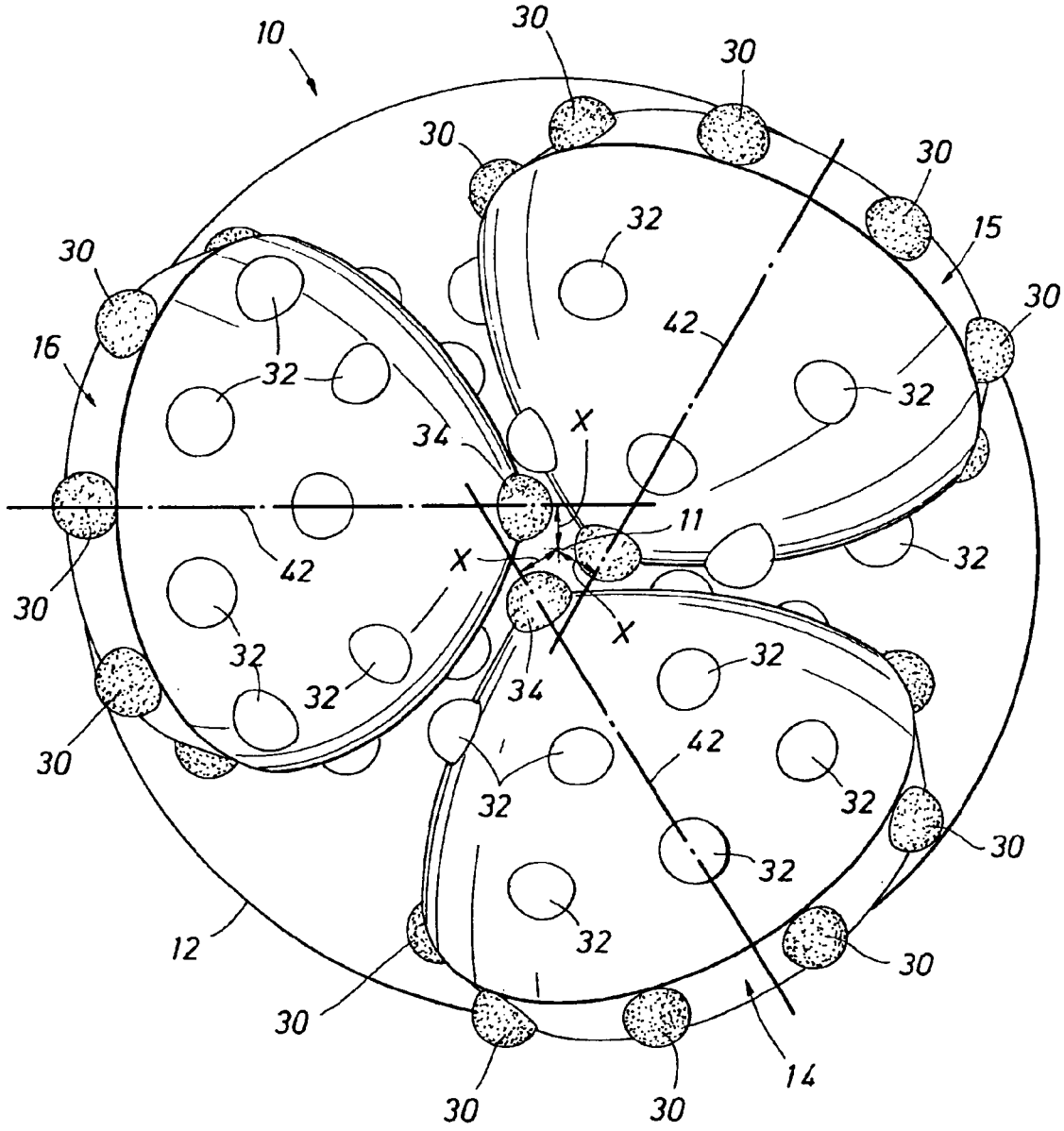
FIG. 3 is a simplified bottom view of the earth boring bit shown in FIG. 1 illustrating the offset axis feature of the invention.

FIGS. 1–3 depict an exemplary three cone roller, insert-type bit 10 constructed in accordance with the present invention. The bit 10 includes a central axis 11 and a bit body 12 having a threaded section 13 on its upper end for securing the bit to the drill string (not shown). Bit 10 has a predetermined gage diameter as defined by three rolling cone cutters 14, 15, 16 rotatably mounted on bearing shafts that depend from the bit body 12.

A single cone cutter, 14, is shown in the cross-sectional view at FIG. 2 mounted upon a bearing shaft 40. Details concerning the mounting of the cutter 14 to the shaft 40, the use of roller bearings, seals and so forth are not described in detail here, as such details are understood by those of skill in the art. As depicted in FIG. 3, the bit 10 is used to drill a borehole having a sidewall 5, corner portion 6, and bottom 7.

Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cutters 14–16, and lubricant reservoirs 17 that supply lubricant to the bearings of each of the cutters. During operation of the bit 10, drilling fluid is pumped from the surface through fluid passages where it is circulated through an internal passageway (23 in FIG. 2) to nozzles 18 (FIG. 1).

Cutters 14–16 include a frustoconical surface 20 that is adapted to retain cutter elements that scrape or ream the sidewalls of the borehole as cutters 14–16 rotate about the borehole bottom. Frustoconical surface 20 will be referred to herein as the "heel" surface of cutters 14–16, it being understood, however, that the same surface may be sometimes referred to by others in the art as the "gage" surface of a rolling cone cutter.

Inwardly adjacent upon each of the cone cutters 14, 15, 16 from heel surface 20 is a generally conical surface 22 adapted for supporting cutter elements that gouge or crush the borehole bottom as the cone cutters rotate about the borehole. Frustoconical heel surface 20 and conical surface 22 converge in a circumferential edge or shoulder 24. Although referred to herein as an "edge" or "shoulder," it should be understood that shoulder 24 may be contoured, such as a radius, to various degrees such that shoulder 24 will define a contoured zone of convergence between frustoconical heel surface 20 and the conical surface 22.

In the embodiment of the invention shown in FIGS. 1, 2, 3 and 5, each cone cutter 14, 15 and 16 includes a plurality of wear resistant inserts 26, 28, 30. These inserts 26, 28 and 30 each include a generally cylindrical base portion and a cutting portion that extends from the base portion and includes a cutting surface for cutting formation material. All or a portion of the base portion is secured by interference fit into a mating socket drilled into the lands of the cone cutter. Inserts 26, 28 and 30 are formed of tungsten carbide. Depending upon the particular application, some or all of the inserts 26, 28 and 30 may be coated with a super-abrasive layer. The term super-abrasive, as used herein, refers to substances that are significantly harder than the precemented tungsten carbide currently used in roller-cone rock bits. Currently known super-abrasive materials include polycrystalline diamond (PCD) and polycrystalline cubic boron nitride (PCBN). Inserts 26 are referred to as heel row inserts. Inserts 28 are referred to as gage row inserts. Inserts 30 are referred to as off-gage cutter inserts, meaning that their cutting surfaces do not extend to full gage diameter. Heel row inserts 26 are secured in a circumferential row along the frustoconical heel surface 20. Gage inserts 28 are secured to the cutters 14, 15, 16 in locations along or near the circumferential shoulders 24. Off-gage cutter inserts 30 are secured in a first inner row along surface 22.

Cutters 14, 15 and 16 further include a plurality of inner row inserts 32 secured to cone surface 46 and arranged in spaced-apart inner rows respectively. The inner row inserts 32 may also be coated with super-abrasive material, such as PCD. However, they can also be formed of tungsten carbide, or another softer material, and be free from super-abrasive coatings.

Figure 4:
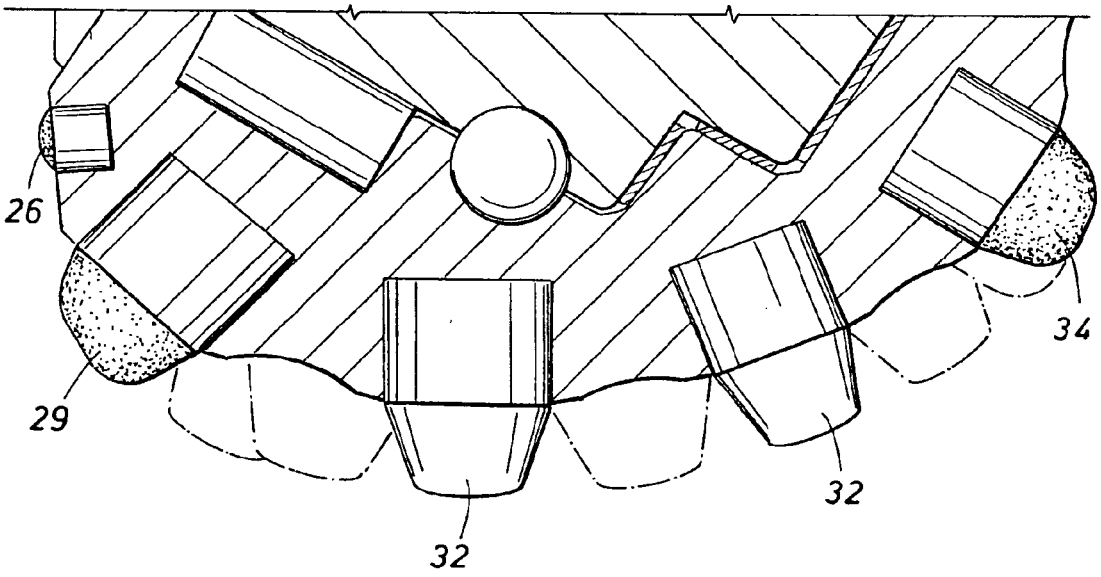
FIGS. 4 and 5 are cross sectional views showing two alternative profiles for insert-type rolling cone cutters in accordance with the present invention.
Figure 5:
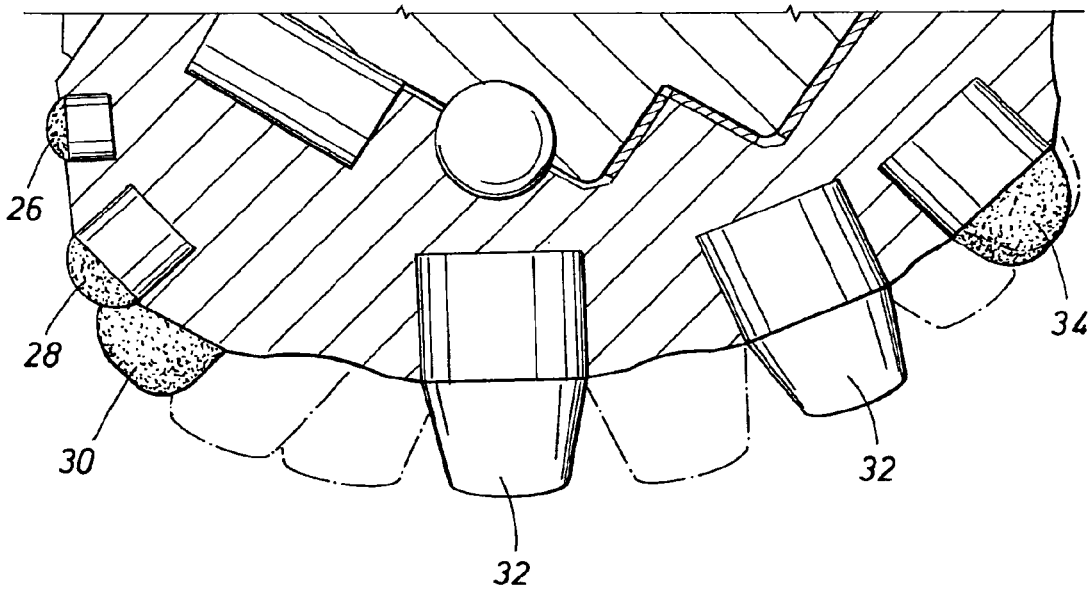

FIGS. 4 and 5 provide more detailed views of two alternative cutter profiles for roller cone cutters constructed in accordance with the present invention. The cutter profile in FIG. 5 is that depicted in FIGS. 1–3. In the profile shown in FIG. 4, however, there are no off-gage inserts, instead, gage inserts 29 are provided which are larger and positioned on surface 22 rather than on shoulder 24. This type of cutting structure is described in further detail in co-pending U.S. patent application Ser. No. 08/667,758 entitled "Rolling Cone Bit with Enhancements in Cutter Element Placement and Materials to Optimize Borehole Corner Cutting Duty"

which is assigned to the assignee of the present invention. That application is incorporated herein by reference. The gage inserts 29 are intended to, and do, engage the borehole corner 6, thus assisting in cutting both the bottom of the borehole 7 and the side 5, thereby maintaining the gage of the borehole.

In an alternate embodiment (not shown), the insert 28 and insert 30 of FIG. 5 both have their cutting surfaces extending to full gage diameter. Insert 30 would be the gage insert, sometimes referred to as the primary gage insert, and insert 28 would be a secondary gage insert sometimes known as a "nestled" gage insert. Co-pending patent application Ser. No. 08/667,758 describes bits which incorporate such a structure. A secondary gage insert helps to cut the borehole wall to full gage diameter cooperatively with the primary gage insert. A primary gage insert due to its position on the bit generally does more work and will wear and/or break before a secondary gage row, thus giving importance to the secondary row as a back-up gage row as well. The heel row inserts 26, if placed to full gage diameter acts as a back-up gage cutting element as well.

A row of nose inserts 34 is also provided on each cutter 14, 15, 16. The nose inserts 34 are preferably coated with super-abrasive material, such as PCD. However, they can also be formed of tungsten carbide, or another softer material, and be free from super-abrasive coatings.

Referring specifically to FIG. 1, a plurality of generally frustoconical segments 36 are shown that are generally referred to as "lands" which support and secure the inserts 30, 32 to the cone cutters 14, 15 and 16. Grooves 38 are shown formed between adjacent lands 36.

Referring now to FIG. 3, a simplified bottom view of the bit 10 is provided. Each cutter 14–16 is rotatably mounted on a pin or journal 40, with an axis of rotation 42 oriented generally downwardly and inwardly toward the center of the bit 10. As noted, the bit 10 has a central longitudinal axis 11. Each of the roller cone cutters 14, 15, 16 has an individual rotational axis 42.

The axis of rotation 42 for the cone cutter about its journal 40 departs from the normal of the bit axis 11 at a journal angle 45 illustrated in FIG. 2. A journal angle 45 of about 32.5° to about 33° has been found to be optimal for soft to medium formations. An increased journal angle 45 of about 36° to about 39° has been found to be optimal for medium-hard to harder formations.

Figure 6:
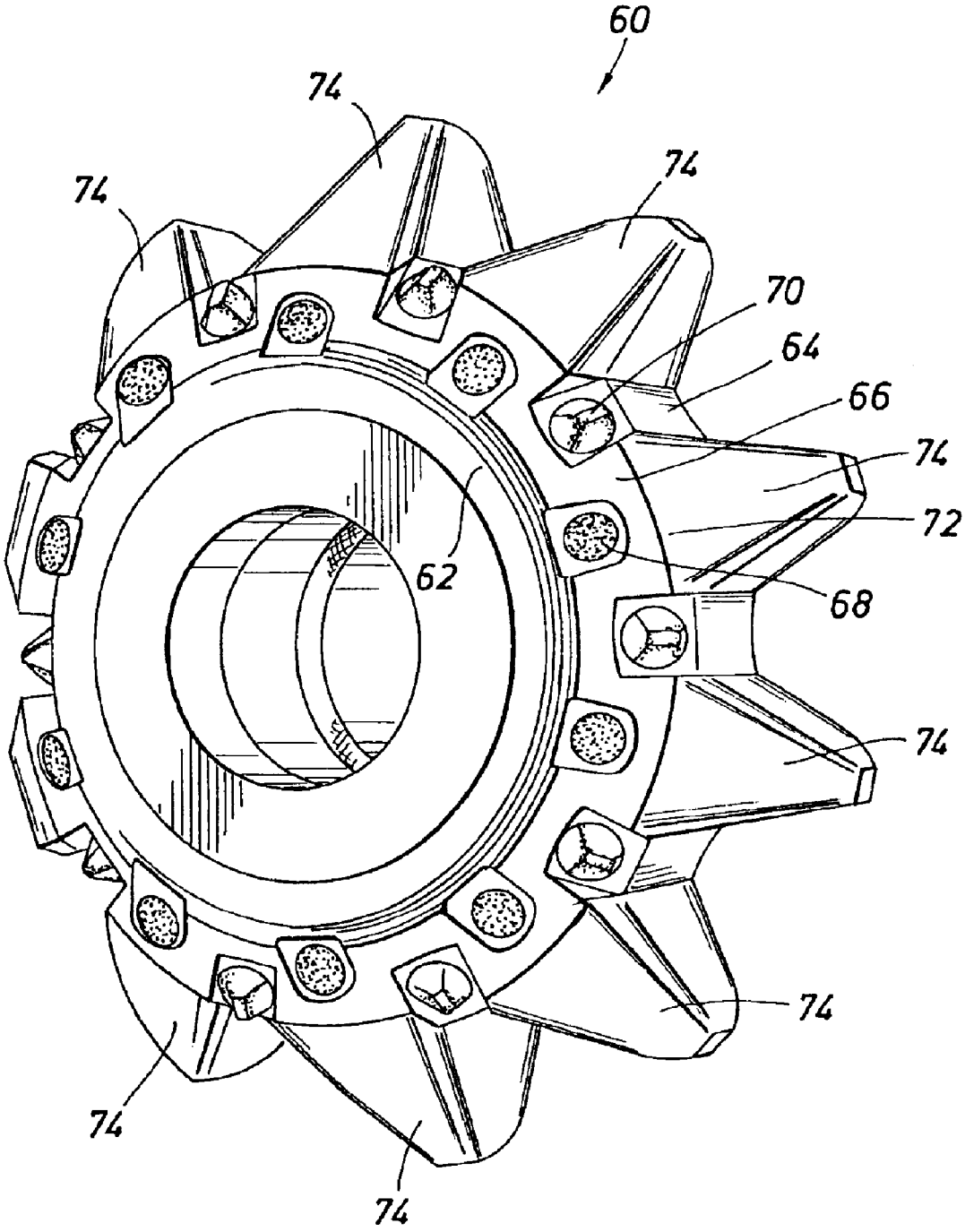
FIG. 6 depicts an exemplary milled tooth rolling cone cutter made in accordance with the present invention.

The invention may also be employed in a milled tooth bit having integrally-formed inner row teeth, such as the cutter 60 illustrated in FIG. 6. The cutter 60 includes a backface 62, a generally conical surface 64 and a heel surface 66 which is formed between the conical surface 64 and the backface 62. The milled tooth cutter 60 includes heel row inserts 68 embedded within the heel surface 66 and nestled gage row cutter elements such as nestled gage inserts 70 disposed adjacent to the circumferential shoulder 72. Preferably, both the heel row inserts 68 and the nestled gage inserts 70 extend to full gage during operation, thus contacting and cutting the borehole wall 5. In addition, the steel tooth cutter 60 includes a plurality of gage row cutter elements 74, generally formed as radially-extending teeth, and inner rows (not shown) of the same type of teeth. The steel teeth include an outer layer or layers of hardfacing to improve the durability of the cutting elements.

When the invention is employed with a milled tooth bit, the heel row inserts 68, which engage and help cut the borehole sidewall, are formed of super-abrasive inserts. In addition, the a nestled gage inserts 70, which also engage and assist in cutting the borehole wall during operation, may be formed of super-abrasive inserts.

Referring again to FIG. 3, the high offset feature is illustrated. Each cutter rotational axis 42 is oriented so as to lie in a plane located in an offset distance "X" from the central axis of the bit, X being measured by the shortest distance between the axis 11 and the axis 42.

The amount of offset "X" necessary to provide a "high" offset generally increases as the bit diameter increases. However, the change in amount of the desirable "high" offset preferably does not vary linearly with changes in bit diameter, as one might expect.

Insert bits used for soft through medium-hard formations are considered to be those bits having an IADC numeric designation of 6-2-x or less. These bits also generally feature journal angles that are between about 32.5° and about 36°. Steel tooth bits used for soft through medium hardness formations are considered to be those bits having an IADC numeric designation of less than 2-3-x or less. These bits also generally feature journal angles that are between about 32.5° and about 36°. For insert bits used within soft to medium-hard formations, generally classified as an IADC of 6-2-x or lower series number, and milled tooth bits, generally classified as an IADC of 2-3-x or lower series, a high offset is defined and described as the offset distances set forth in the following table (Table 1).

TABLE 1

Minimum High Offset Distances for Milled Tooth Bits and Insert Bits for Soft to Medium Hardness Formations

| Bit Diameter (D) | High Offset Distance (X) |
|---|---|
| D < 4" | X ≧ 1/8" |
| 4" ≦ D < 5" | X ≧ 5/32" |
| 5" ≦ D < 7" | X ≧ 1/4" |
| 7" ≦ D < 9" | X ≧ 11/32" |
| 9" ≦ D < 12" | X ≧ 13/32" |
| 12" ≦ D < 16" | X ≧ 7/16" |
| 16" ≦ D | X ≧ 17/32" |

It is believed that the invention will provide the best performance in the soft formations associated with bits classified as an IADC of 4-4-x or lower series for insert bits and an IADC of 1-3-x or lower series for milled tooth bits.

Table 2 below provides exemplary recommended high offset distances for various diameters of insert-type bits. Different high offsets are recommended for these types of drill bits depending upon the degree of hardness and compressive strength of the formation within which they are expected to be used. These offset distances are believed to be particularly effective when used with the super-abrasive cutting inserts as described herein in producing optimal increases in ROP and bit durability, including the ability of the bit to hold gage.

TABLE 2

Recommended High Offset Distances for Insert-Type Bits Used for Soft Through Medium Type Formations

| | High Offset (X) Ranges | | |
|---|---|---|---|
| Bit Diameter (D) | Range 1 | Range 2 | Range 3 |
| D < 4" | 1/8" ≦ X < 5/32" | 5/32" ≦ X < 3/16" | 3/16" ≦ X |
| 4" ≦ D < 5" | 5/32" ≦ X < 3/16" | 3/16" ≦ X < 1/4" | 1/4" ≦ X |
| 5" ≦ D < 7" | 1/4" ≦ X < 9/32" | 9/32" ≦ X < 5/16" | 5/16" ≦ X |
| 7" ≦ D < 9" | 11/32" ≦ X < 3/8" | 3/8" ≦ X < 7/16" | 7/16" ≦ X |

TABLE 2-continued

Recommended High Offset Distances for Insert-Type Bits Used for Soft Through Medium Type Formations

| | High Offset (X) Ranges | | |
|---|---|---|---|
| Bit Diameter (D) | Range 1 | Range 2 | Range 3 |
| 9" ≦ D < 12" | 13/32" ≦ X < 15/32" | 15/32" ≦ X < 9/16" | 9/16" ≦ X |
| 12" ≦ D < 16" | 7/16" ≦ X < 19/32" | 19/32" ≦ X < 3/4" | 3/4" ≦ X |
| 16" ≦ D | 17/32" ≦ X < 3/4" | 3/4" ≦ X < 1" | 1" ≦ X |

The three offset ranges provided in Table 2 for the various bit diameter ranges provide preferable offsets for the various bit configurations, formation types and desired drilling parameters and applications. It is believed that Range 1 offsets are best suited for medium strength formations, Range 2 offsets are best suited for soft to medium strength formations and Range 3 offsets are best suited for soft or low strength formations. However, the particular conditions of a drilling operation may indicate that the ranges are used in other different formations. Range 3 offsets offer the largest ROP increases, particularly for a soft formation bit, however, a Range 3 offset may be too great when used with a medium formation bit causing lower than desired bit durability due to the increased scraping being imparted on the inserts. Desired performance also helps dictate which offset range is desired as a Range 1 offset has the potential to offer the maximum footage to be drilled at moderate increases in ROP, while Range 3 has the potential to offer the maximum ROP at potential decreases in footages drilled.

The amount of super-abrasive cutting inserts used also will affect the amount of offset used as well as the ROP and footage drilled by the bit. Generally, the more diamond used, the more offset can be used to increase ROP, to better resist the increased scraping, and to maximize the footage drilled. Also, as the formation strength increases, more super-abrasive inserts are required, particularly when going from a Range 1 offset to a Range 3 offset.

If a soft formation bit uses a Range 3 offset, the bit would be expected to drill at a significant increase in ROP. However, the amount of footage drilled may require super-abrasive cutting inserts in the gage rows and heel rows of the bit to drill the footage that the conventional low offset bit would. If this soft formation bit were instead to use a Range 1 offset, the bit would be expected to drill at only a moderate increase in ROP. However, the bit may only require super-abrasive cutting inserts in the gage row or the heel row of the bit to drill the equivalent footage that the conventional low offset bit would. Additionally, if the soft formation bit using the Range 1 offset were to have super-abrasive cutting inserts in the gage row, heel row and off-gage row, the bit would be expected to drill at a moderate increase in ROP and would be expected to be able to drill more footage than the conventional low offset bit. Using the Range 2 offsets in the embodiments above produce more balance between expected increases in ROP and footages drilled. It is preferred that when using any of the offset ranges listed in Table 2, the bits use some form of super-abrasive inserts in areas/rows of the cones that cut the borehole to a substantially full gage diameter. Otherwise, the borehole will quickly go undergage causing drilling problems and costly premature replacement of the bit. There are multiple combinations of the offset ranges in Table 2, super-abrasive insert densities, formation strengths, etc. that can be used to meet the specific drilling performance needs such as increased ROP, footage drilled, and gage integrity.

Certain characteristics of three cone roller bit designs are altered so that the bit will perform optimally in different situations and in different formation types. As noted, the journal angle 45 (shown in FIG. 2) is increased for harder formations. An increase in journal angle still permits offset of the journal axes from the bit axis and it also allows the cone to be designed to impart a truer rolling motion and less skidding motion on the hole bottom. Hard formation insert bits with IADC numeric nomenclatures of 6-3-x typically have journal angles of at least 36,° usually between 36° and 39°. This is not always the case, however, as a particular bit having a journal angle of less than 36° could be designed which would be classified with a "hard formation" nomenclature of 6-3-x or greater by altering other aspects of its cutting structure, such as cutter count, cutter geometry, cutter extension and cutter type. The present invention recognizes that the high offset concept may apply differently to hard formation bits than to bits used primarily for soft formation and medium formation bits due to differences in journal angles and other design aspects. Nonetheless, the use of high offset with super-abrasive cutters provides improved cutting structures in hard formation bits as well. The offset is generally smaller on hard formation bits, relative to soft formation bits, to allow the cones to rotate more freely on the hole bottom, thus incurring less of the gouging and scraping action and more of a crushing action. Conventional tungsten carbide inserts on a hard formation bit will generally wear away rapidly if the offsets typical of soft formation bits are used in them because of the increased scraping action on the hole bottom and hole wall. Thus, medium to hard formation bits have been limited to the low offsets and higher journal angles to allow them to drill acceptable amounts of formation before wearing out. Hard formation bits typically drill much slower than soft formation bits because the formation being drilled is harder and stronger and because they have the lower offsets. Thus, for hard formation insert bits, high offsets are defined and described by the following table. Hard formation bits are typically those bits having an IADC numeric nomenclature of 6-3-x or higher.

TABLE 3

Minimum High Offset Distances for Insert-Type Bits Used for Hard Type Formations

| Bit | High Offset (X) Ranges for 6-3-x or Higher | | |
|---|---|---|---|
| Diameter (D) | Range A | Range B | Range C |
| D < 7" | 1/16" ≦ X < 3/32" | 3/32" ≦ X < 1/8" | 1/8" ≦ X |
| 7" ≦ D < 12" | 3/32" ≦ X < 5/32" | 5/32" ≦ X < 7/32" | 7/32" ≦ X |
| 12" ≦ D | 5/32" ≦ X < 7/32" | 7/32" ≦ X < 9/32" | 9/32" ≦ X |

For these hard formation insert bits, it is further recommended that super-abrasive cutters be used for all cutter rows, including the inner rows 32, since the increase in the journal angle 45 results in increased scraping and grinding action during use for the inner row cutters 32. For certain hard formations being drilled, it may be advantageous to use multiple rows of inserts on each cone that cut the borehole to its substantial full gage diameter. Some of these insert rows have inserts formed of tungsten carbide/cobalt while other rows are diamond coated tungsten carbide/cobalt to increase the overall durability of the bit. Additionally, some of the inner rows may include cutters of both types. The inner row inserts should include a substantial amount of super-abrasive inserts rows when the high offset ranges per Table 3 are used in hard formation type bits.

The three offset ranges provided in Table 3 for the various bit diameter ranges provide suitable offsets for the various bit configurations, formation types and desired drilling parameters and applications for hard formation bits. It is believed that Range A offsets are best suited for extremely hard, high strength and abrasive formation bits, Range B offsets are best suited for hard, high strength, abrasive formation bits and Range C offsets are best suited for hard, semi-abrasive formation bits. In specific applications it would be beneficial to use a range A offset on a high strength formation bit to increase ROP moderately while increasing footage drilled for specific applications, while in another application it may be beneficial to use a Range C offset to substantially increase ROP while maintaining. There are multiple combinations of the offset ranges in Table 3, super-abrasive insert densities, formation strengths, etc. that can be used to meet the specific drilling performance needs such as increased ROP, footage drilled, and gage integrity. Medium-hard to extremely hard formation bits, typically those with an IADC series of 6-1-x or higher and having a journal angle of at least 36° and super-abrasive cutter elements in at least a portion of the inner rows of the cones would benefit from the high offsets listed for hard formation bits as well that are listed in Table 3 by imparting more of a shearing action to the hole bottom to increase ROP and the super-abrasive inserts will not wear away like the conventional tungsten carbide inserts would. It is currently preferred for all bits that the amount of high offset be substantially the same for each of the roller cone 14, 15 and 16. If desired, however, the amount of high offset may be varied from cone to cone based upon expected work load for each cone such that the offset of at least one cone is different from that of the remaining cones.

In operation, bits constructed in accordance with the present invention provide improved ROPs. The bit 10 will be used as an example to explain. Because the axes 42 of the roller cone cutters 14, 15 and 16 are offset from the axis 11 of the bit 10 to the degree specified above to achieve the defined "high offset," the bit 10 provides a greater amount of scraping and grinding of the surrounding rock. This scraping and grinding action is particularly effective in wearing away and removing the borehole bottom 7 due to more of a shear component applied to the rock. Generally cutting efficiency of rock is better when the rock is cut in a shear mode rather than it being failed/removed by crushing or compressive modes. Generally, greater offsets will result in faster removal of the borehole bottom 7, thus increasing ROP overall for the bit. Because high offsets are used, the drilling rate is greatly increased. High offsets are generally most effective for softer formations, although high offset bits having lower ranges of high offsets are particularly useful in harder formations due to their increase grinding and scraping action.

As noted, increases in offset impart more damaging scraping forces to the inserts of the bit. Thus, the bit is subjected to much greater wear forces. The invention teaches the use of super-abrasive cutter elements to ensure that the bit is sufficiently durable to withstand these greater wear forces so that it can achieve acceptable footage and maintain ROP.

In accordance with the invention, at least some of the inserts that engage the borehole wall 5, thus helping to cut to gage, have super-abrasive cutting surfaces. The super-abrasive cutters provide high impact strength during drilling as well as exceptional wear resistance. Additionally, super-abrasive cutters have been found to provide an unexpectedly low incidence of insert breakage, despite the fact that the hardness of the cutter is increased. Also in accordance with the invention, the hard formation bits, IADC 61x and harder, have a substantial amount of super-abrasive inner row inserts to combat the excessive wear that would otherwise be present if just typical tungsten carbide inserts were used.

In operation, heel row inserts 26 generally function to scrape or ream the borehole sidewall 5 to maintain the borehole at full gage. Secondarily, they prevent erosion and abrasion of heel surface 20. Inner row cutter inserts 32 are employed primarily to gouge and remove formation material from the borehole bottom 7. Inner row inserts 32 are arranged and spaced on each cone cutter so as not to interfere with the inner row inserts 32 on each of the other cone cutters during operation. In the embodiment shown in FIGS. 1 and 5, the gage row inserts 28 and the off-gage inserts 30 cooperate to cut the corner portion 6. Off-gage inserts 30 have cutting surfaces that extend close to, without achieving, full gage. Thus, they are located as the first row of inner inserts.

In the preferred embodiment of FIGS. 1 and 5, the gage cutter inserts 28 are super-abrasive as these inserts tend to primarily dictate the gage of the borehole being drilled and are most affected by an increase in offset. It is further preferred that the heel row inserts 26 are also super-abrasive inserts, as the heel row inserts 26 follow the gage inserts 28 as the borehole is drilled and, thus, assist in maintaining the borehole at full gage. If present in a particular bit design, the off-gage cutter inserts 30 are also preferably super-abrasive inserts. Because the off-gage cutter inserts 30 engage the corner portion 6 of the borehole, they also assist in maintaining the gage of the borehole. The use of super-abrasive inserts allows the increased offsets to be used effectively because the usual increased wearing of the gage cutting portions of the bit 10, which occurs with increased offsets, is eliminated.

It is also believed that using super-abrasive inserts that extend to a near gage diameter will cut at least a portion of the bore hole corner to allow conventional inserts extending to full gage diameter to trim or cut the final borehole diameter, thus allowing for the effective use of high offsets. An insert extending to "near gage" diameter is considered to be one that comes within 3/16 of an inch of the full gage diameter. For example, a 12¼ inch bit would have a full gage diameter of 12¼ inches and a near gage diameter range of 11⅞–12¼ inches. Near gage diameter inserts can, therefore, include heel, gage, off-gage, Trucut gage, nestled gage and secondary gage inserts.

While various preferred embodiments of the invention have been shown and described, modifications thereof can be made by one skilled in the art without departing from the spirit and teachings of the invention. The embodiments described herein are only exemplary and are not limiting. Many variations in modifications of the invention and apparatus disclosed herein are possible and are within the scope of the invention. Accordingly, the scope of protection is not limited by this description set out above, but is only limited by the claims which follow, that scope, including all the equivalence of the subject matter of the claims.

What is claimed is:

1. A medium-bard to extremely hard formation-type earth boring bit comprising:

a) a bit body having a longitudinal bit axis and a bit diameter;

b) at least one wiling cone cutter rotatably mounted on the bit body and having an offset of its rotational axis from the bit axis of:

i) at least 1/16 inches when the bit diameter is less than 7 inches, ii) at least 3/32 inches when the bit diameter is at least 7 inches and less than 12 inches, iii) at least 5/32 inches when the bit diameter is at least 12 inches; and c) a journal angle being formed between the rotational axis and the bit axis of at least 36°;

d) at least one super-abrasive cutter element located on an inner row of the cone cutter.

2. The bit of claim 1 wherein the super-abrasive cutter element comprises a polycrystalline diamond coated insert.

3. The bit of claim 1 wherein the super-abrasive cutter element comprises a cubic boron nitride coated insert.

4. The bit of claim 1 wherein the amount of offset is:

a) at least 3/32 inches and less than 1/8 inches when the bit diameter is less than 7 inches, b) at least 5/32 inches and less than 7/32 inches when the bit diameter is at least 7 inches and less than 12 inches, or c) at least 7/32 inches and less than 9/32 inches when the bit diameter is at least 12 inches.

5. The bit of claim 1 wherein the amount of offset is:

a) at least 1/8 inches when the bit diameter is less than 7 inches, b) at least 7/32 inches when the bit diameter is at least 7 inches and less than 12 inches, or c) at least 9/32 inches when the bit diameter is at least 12 inches.

6. The bit of claim 1 wherein the bit comprises an insert bit having an IADC classification of 6-1-x or higher series number.

7. The bit of claim 1 further comprising a super-abrasive cutter element located on a gage row of the rolling cone cutter.

8. The bit of claim 1 further comprising a super-abrasive cutter element located on a secondary gage row of the rolling cone cutter.

9. The bit of claim 1 further comprising a super-abrasive cutter element located on a heel row of the rolling cone cutter.

10. The bit of claim 1 further comprising super-abrasive elements located on all the inner rows of all the rolling cone cutters.

* * * * *